United States Patent [19]

Fortenbery

[11] 3,985,351

[45] Oct. 12, 1976

[54] WEB FOLDING APPARATUS

[76] Inventor: Justice A. Fortenbery, Rte. 2, Benton, Ky. 42025

[22] Filed: Jan. 8, 1976

[21] Appl. No.: 647,656

[52] U.S. Cl. ..... 270/62; 270/68 R; 270/80

[51] Int. Cl.[2] ..... B65H 45/12

[58] Field of Search ..... 270/61 R, 62, 67, 68 R, 270/80–82; 93/84 R; 223/37

[56] References Cited

UNITED STATES PATENTS

| | | | |
|---|---|---|---|
| 1,201,719 | 10/1916 | Groff | 270/67 |
| 3,167,223 | 1/1965 | Weiss | 223/37 |

*Primary Examiner*—Edgar S. Burr
*Assistant Examiner*—A. Heinz
*Attorney, Agent, or Firm*—Harrington A. Lackey

[57] ABSTRACT

A web folding apparatus including two pairs of creasing plates, a creasing bar or element, and cooperative mechanism causing the crease bar to move toward the plates to form a crease in a piece of sheet material, and causing the hinged pairs of plates to swing toward each other as the crease bar moves away, to fold the creased sheet material about a fold line substantially perpendicular to the crease line.

The apparatus is particularly useful in folding the ends of flexible webbing preparatory to being grommeted, as for example in lawn furniture.

10 Claims, 10 Drawing Figures

WEB FOLDING APPARATUS

BACKGROUND OF THE INVENTION

This invention relates to an apparatus for folding sheet material, and more particularly to an apparatus for creasing and folding web material.

Heretofore, particularly in the art of making elongated flexible web strips, such as for use in the manufacture or repair of lawn furniture, the ends of the flexible web strips are conventionally creased and folded by hand preparatory to being secured by grommeting. Needless to say, such hand folding operations consume a considerable amount of time, and consequently labor.

Although there are various types of creasing or folding devices in the prior art, nevertheless none of them seem to lend themselves to the particular creasing and folding steps required in the formation of the ends of flexible web material for lawn furniture, much less incorporating the cooperative elements of the web folding device made in accordance with this invention.

SUMMARY OF THE INVENTION

This apparatus is adapted to sequentially form a crease and a fold line substantially at right angles to the crease line in a piece or web of sheet material so that, in one cycle of the apparatus, sheet material is creased and the creased parts are then folded together upon themselves.

The specific apparatus for carrying out this sheet creasing and folding operation includes two pair of jaws or jaw plates, each pair of jaw plates being biased toward each other to pinch the sheet material forced between them to form the crease. One pair of jaw plates is hinged relative to the other pair of jaw plates so that the first pair of jaw plates may be swung through approximately 180° from an aligned creasing position to a folding position in which the first pair of plates overlies the second pair of plates substantially parallel to each other. The apparatus further includes a creasing bar or element adapted to be moved to intially force the sheet material between the aligned pair of plates to form the crease.

The apparatus further includes cooperating mechanism and elements operatively connected to the jaw plates and the creasing bar so that, upon actuation, the creasing bar is moved toward the aligned jaw plates in their creasing position, and away from the jaw plates as the jaw plates swing together in a folding position.

DESCRIPTION OF THE PREFERRED EMBODIMENTS

Figure 1:
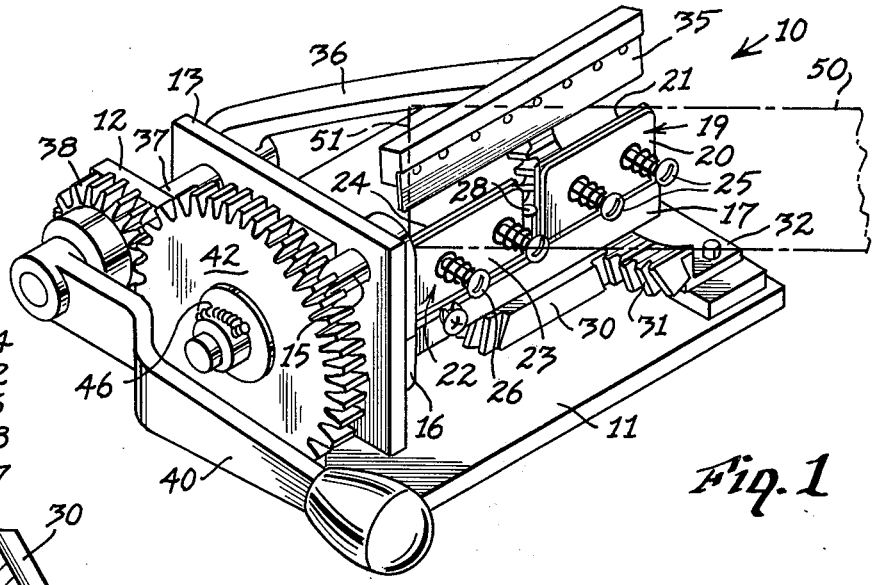
FIG. 1 is a front perspective view of the apparatus made in accordance with this invention, showing the end portion of a web in its initial phantom position preparatory to being creased.
Figure 4:
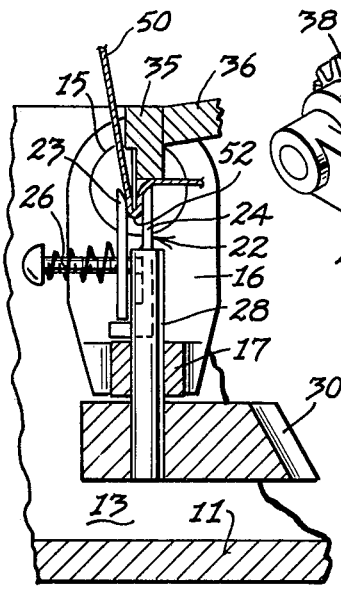
FIG. 4 is an enlarged, fragmentary section taken along the line 4—4 of FIG. 3.
Figure 3:
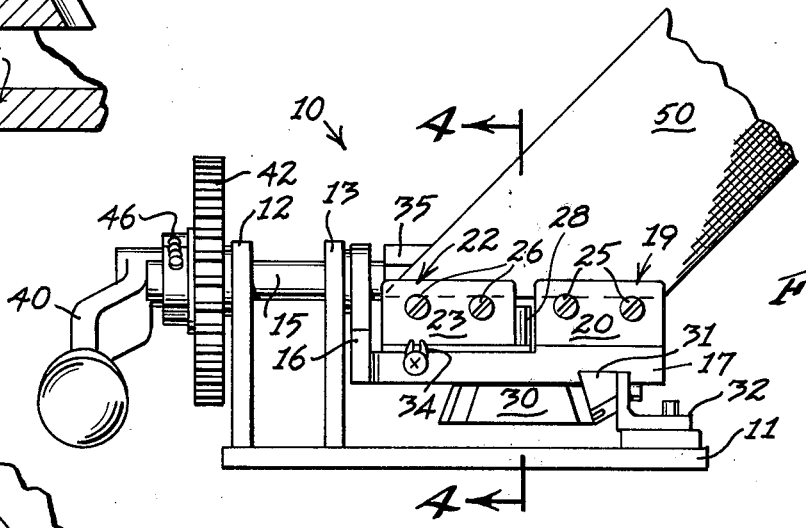
FIG. 3 is a front elevation of the apparatus disclosed in FIG. 1 in which the end portion of the web, in solid-line position, has been creased.
Figure 5:
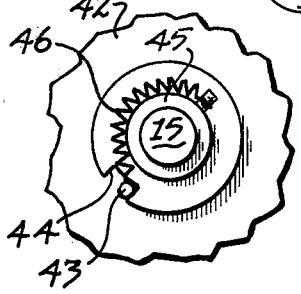
FIG. 5 is an enlarged, fragmentary left-end elevation of the apparatus disclosing the lost-motion mechanism.
Figure 2:
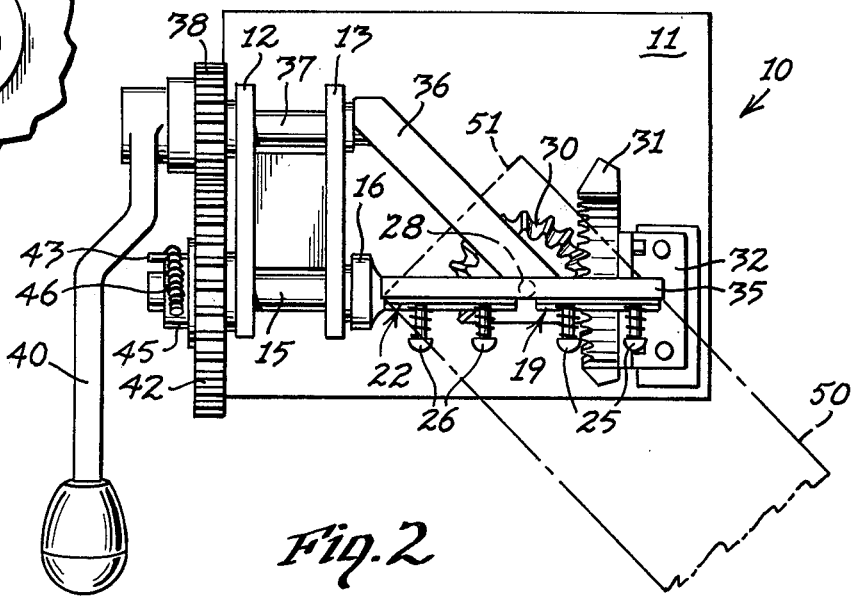
FIG. 2 is a top plan view of the apparatus disclosed in FIG. 1.

Referring now to the drawings in more detail, the web folding apparatus 10 made in accordance with this invention includes a base plate 11 upon the left end of which is fixed a pair of upstanding shaft brackets 12 and 13.

Journaled in the support brackets 12 and 13 is a main shaft 15 from the inner end of which is fixed and depends a crank arm 16. From the lower end of the crank arm 16 projects an elongated jaw support member or bar 17. Mounted upon the jaw support member 17 are a first pair 19 of jaw plates 20 and 21 and a second pair 22 of jaw plates 23 and 24. The jaw plate 21 is integrally fixed to the jaw support bar 17, while its opposed jaw plate 20 is biased toward the jaw plate 21 by the spring members 25. In a similar manner, the jaw plate 23 is biased toward the jaw plate 24 by the spring members 26, although neither of the jaw plates 23 or 24 are rigid with respect to the jaw support arm 17.

Figure 7:
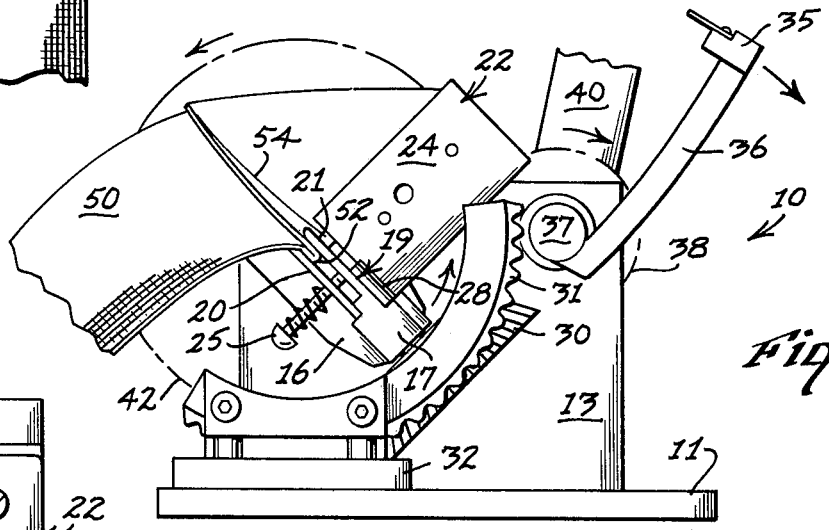
FIG. 7 is a view similar to FIG. 6 in which the elements are in a subsequent position forming a fold in the creased end of the web.

Instead, the jaw plate 24 of the set or pair 22 is fixed at one end to a hinged shaft 28 which extends through, and is journaled in, the jaw support member 17. Thus, by virtue of the hinged connection between the jaw pair 19 and the jaw pair 22, the jaw pairs may swing between their aligned creasing position disclosed in FIGS. 1–4 to their folding position, disclosed in FIG. 8, in which the jaw pair 22 has moved through approximately 180° and overlies the fixed jaw pair 19. FIG. 7 discloses the swinging jaw pair 22 in an intermediate folded position in which the jaw pair 22 is substantially at right angles to the jaw pair 19.

The hinge shaft 28 depends below, or on the opposite side from the hinge plates 19 and 22, of the jaw support member 17, and is fixed to a gear segment 30. The teeth of the gear segment 30 mesh with the cooperating teeth of a gear quadrant 31 fixed upon the base plate 11 by the bracket 32. The arcuate dimension of the gear quadrant 31 extends parallel to, and slightly below, the arcuate path of the jaw support member 17 as it moves between the creasing position in FIG. 6 and the folding position in FIG. 8, or substantially through a 90° arc.

The jaw support member 17 may be provided with a stop 34 to limit the return swinging movement of the hinged jaw pair 22 to its position aligned with the jaw pair 19.

To cooperate with the aligned jaw pairs 19 and 22, an elongated creasing element or bar 35 is fixed to one end of a crease arm 36. The opposite end of the crease arm 36 is fixed to the inner end of the crease rotary shaft 37 journaled behind the main shaft 15 in the brackets 12 and 13. The outer portion of the creasing shaft 37 is fixed to a small gear 38, and the outer end of the shaft 37, on the outside of the gear 38, is fixed to an actuator handle 40 adapted to be manually operated.

The small gear 38 in turn meshes with a large gear 42, which is freely journaled upon the main shaft 15. The large gear 42 is connected to the shaft 15 through a lost-motion mechanism, including a pin 43 projecting from and fixed to the outside of the large gear 42 and adapted to travel within a circumferential slot 44 in a hub 45 fixed to the main shaft 15. The spring 46, connecting the hub 45 to the lost-motion pin 43, tends to bias the creasing bar 35 into the raised position disclosed in FIG. 1, spaced from the jaw pairs 19 and 22 to permit introduction of sheet material, such as web 50, between the creasing bar 35 and the jaws 19 and 22.

It will be noted that the spacing of the shafts 15 and 37, as well as the dimensions of the creasing arm 36 and creasing bar 35, is such that the blade of the creasing bar 35 is in alignment with and adapted to be forced between the spring biased pairs of plates 19 and 22 in the creasing position.

In the particular apparatus 10 disclosed in the drawings, the large gear 42 has a diameter twice as great as the diameter of the gear 38. Thus, as the actuator arm is moved through 90°, the creasing bar 35 will also move through 90°. However, the jaw support arm 17 only moves through 45°, so that the jaw support arm 17 and the fixed pair 19 of jaw plates have moved about half-way through their path of travel up the gear quadrant 31, as disclosed in FIG. 7. On the other hand, the ratio of the gear teeth between the gear segment 30 and the gear quadrant 31 is such that the swinging jaw pair 22 has moved about 90° in relation to the fixed jaw pair 19, as also disclosed in FIG. 7.

Figure 8:
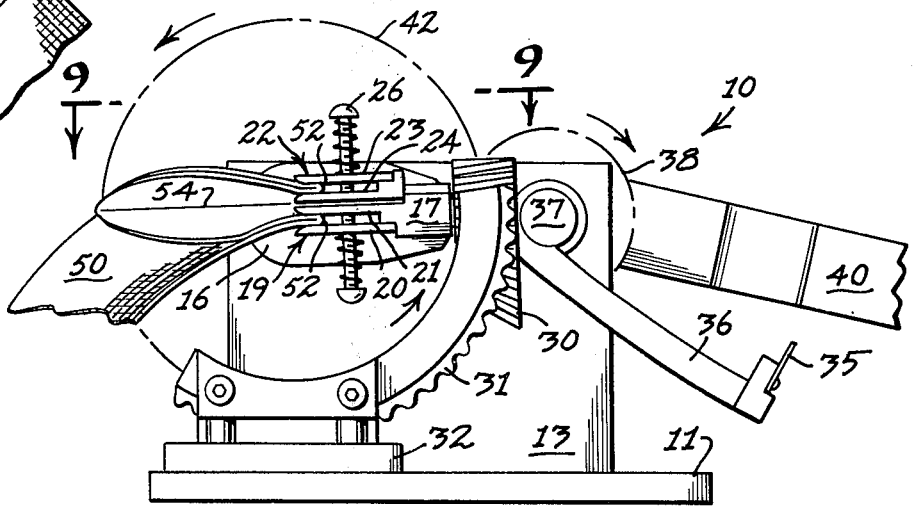
FIG. 8 is a view similar to FIG. 7 in which the elements are in their folding positions.

After the actuator arm or handle 40 has moved through 180° as disclosed in FIG. 8, the creasing bar 35 will also move through an arc of 180°, while the jaw support arm 17 and the fixed jaw pair 19 have moved through 90° to the top of the gear quadrant 31, so that the jaw pair 19 lies in a substantially horizontal plane. In the meantime, the swinging jaw pair 22 has moved through its full 180° so that it also lies horizontally over the top of the fixed jaw pair 19.

In the operation of the apparatus, a strip of sheet material or web 50 is inserted over the top of the aligned jaw pairs 19 and 22 and beneath the creasing bar 35, as disclosed in FIG. 1. In the particular operation disclosed in the drawings, the web 50 is an elongated flexible strip of synthetic web material, particularly adapted for use in lawn furniture, such as lawn chairs. In this operation, one end portion of the web 50 is inserted between the creasing bar 35 and the jaws 19 and 22 so that the web end 51 lies at approximately a 45° angle with the aligned jaw plates 19 and 22. In this position, the actuator handle 40 is depressed to force downward the creasing bar 35 upon the top surface of the web 50. Continued depression of the actuator handle 40 forces the web 50 along a crease line 52, forcing the creased portion of the web 50 down between the opposed pair of jaw plates 20–21 and 23–24, as disclosed in FIGS. 3 and 4.

Figure 6:
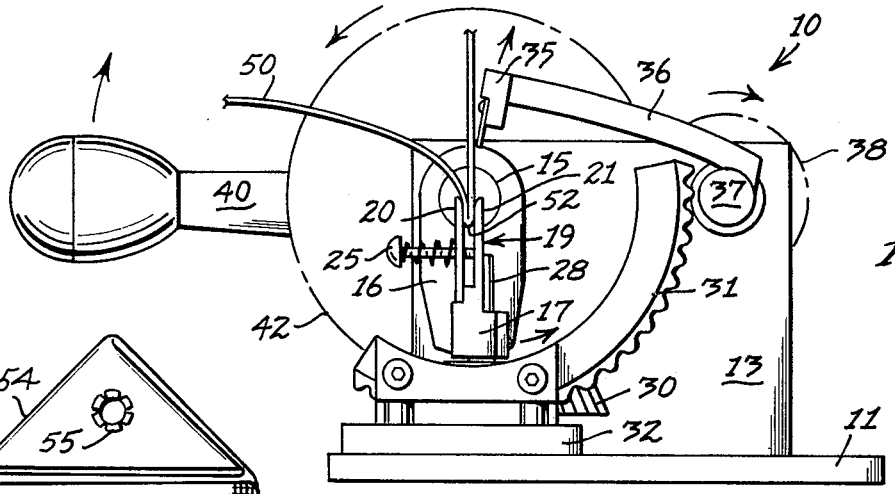
FIG. 6 is a right-end elevation of the apparatus in a position shortly after the crease has been formed.

After the crease line 52 is formed, the actuator handle 40 is moved upward to reverse the movement of the creasing bar 35, causing the creasing bar 35 to rise and separate from the creased web 50, as well as from the biased jaw plates 20, 21, 23 and 24, as best disclosed in FIG. 6. Continued upward rotation of the actuator handle 40 causes the creasing bar 35 to simultaneously move in a parallel arc with the actuator handle 40, while also causing the crank arm 16 to swing the jaw support member 17 and the jaw pairs 19 and 22 upward along an arc parallel to the arcuate contour of the quadrant gear 31. As the jaw support member 17 continues moving upward, the movable jaw pair 22 simultaneously swings upward about the hinge shaft 28, as disclosed in FIGS. 7 and 8 to fold the creased end portion of the web 50 about a fold line 54. Continued rotation of the actuator handle 40 continues to swing the creasing bar 35 away from the jaw pairs 19 and 22, and also causes the jaw support member 17 to move upward through its 90° arc, as disclosed in FIG. 8, until the jaw pairs 19 and 22 have completed the fold about the fold line 54 in the end portion of the web 50. The web 50 is then pulled to remove the creased ends 52 from between the spring-biased jaw pairs 19 and 22.

Figure 10:
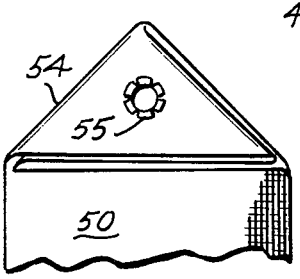
FIG. 10 is a fragmentary plan view of the end of the web material after it has been creased, folded and grommeted.
Figure 9:
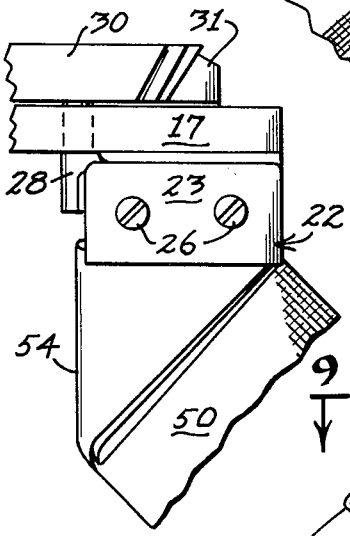
FIG. 9 is an enlarged fragmentary section taken along the line 9—9 of FIG. 8.

It will be noted in FIGS. 9 and 10, that the fold line 54 is substantially at right angles to the crease line 52.

The creased and folded end portion of the web 50 is then secured by a grommet 55 (FIG. 10) in a conventional grommeting machine, not shown. The end of the web 50 is then completed for assembly in the frame of the particular lawn furniture desired.

It is within the scope of this invention to provide actuation of the apparatus 10 by automatic or motorized means rather than manual manipulation of the actuator handle 40.

It is also within the scope of this invention to utilize the apparatus 10 on other types of sheet material in which two subsequently formed crease or fold lines, substantially at right angles to each other, are desired in the sheet material.

What is claimed is:

1. An apparatus for folding a piece of sheet material comprising:

a. a first pair of jaw elements, having opposite ends, forming a first elongated slot therebetween having a depthwise dimension and adapted to receive a creased piece of sheet material, b. a second pair of jaw elements, having opposite ends, forming a second elongated slot therebetween having a depthwise dimension, and adapted to receive a creased piece of sheet material, one pair of ends of said second pair of jaw elements being adjacent one pair of ends of said first pair of jaw elements, c. hinge means pivotally joining said adjacent ends of said first and second pairs of jaw elements, said hinge means having a pivotal axis parallel with the depthwise dimensions of said first and second slots, d. said hinge means permitting said first and second pairs of jaw elements to swing through an approximately 180° angle between a creasing position in which said slots are aligned end-to-end and a folding position in which said second pair of jaw elements substantially overlies said first pair of jaw elements, and said first and second slots are substantially parallel to form a fold in a piece of sheet material held between said first and second pairs of jaw elements, and e. a creasing element for forcing a straight portion of a piece of sheet material into said aligned first and second slots in said creasing position to form an elongated crease in said piece.

2. The invention according to claim 1 comprising first means supporting said first and second pairs of jaw elements for swinging movement about said pivotal axis between said creasing position and said folding position, and second means supporting said creasing element for movement toward said aligned slots when said first and second pairs of jaw elements are in said creasing position and away from said slots when said first and second pairs of jaw elements are moving toward their folding position.

3. The invention according to claim 2 further comprising actuator means for moving said creasing element toward and away from said first and second pairs of jaw elements, cooperative means connecting said first and second supporting means whereby the actuation of said creasing element toward said first and second pairs of jaw elements simultaneously causes said pairs of jaw elements to swing toward said creasing position and the actuation of said creasing element away from jaw elements causes said first and second pairs of jaw elements to move toward said folding position.

4. The invention according to claim 3 further comprising lost-motion means between said creasing element and said first and second pairs of jaw elements to permit limited movement of said creasing element toward and away from said jaw elements in said creasing position, to permit the insertion of a piece of sheet material between said creasing element and said jaw elements, while said jaw elements remain aligned.

5. The invention according to claim 3 in which said first supporting means comprises an elongated jaw support member, said first pair of jaw elements being fixed on said jaw support member, said hinge means being journaled in said jaw support member, first rotary means for swinging said elongated jaw support member about a rotary axis parallel to said elongated jaw support member, said first pair of jaw elements being disposed radially of said rotary axis, hinge actuator means associated with said jaw support member for causing said second pair of jaw elements to swing between said creasing position and said folding position as said jaw support member is rotated from a first position to a second position.

6. The invention according to claim 5 in which said jaw support member is fixed to a crank arm and projects from said crank arm parallel to the rotary axis of said first rotary means, said first rotary means comprising a rotary shaft fixed to said crank arm.

7. The invention according to claim 5 in which said hinge actuator means comprises a stationary gear quadrant spaced beneath and parallel to the rotary path of said jaw support member, a gear member fixed to said hinge means and meshing with said gear quadrant to cause said second pair of jaw elements to move between its creasing position and said folding position as said jaw support member swings between its first position and said second position.

8. The invention according to claim 5 in which said second supporting means comprises a crease arm fixed to said creasing element, second rotary means fixed to said crease arm for swinging said creasing element between a first position forcing said crease arm into said aligned slots when said jaw elements are in said creasing position and a second position away from said jaw elements, transmission means cooperatively connecting said first and second rotary means for simultaneous rotary movement, said actuator means being adapted to drive one of said rotary means.

9. The invention according to claim 8 in which said cooperative transmission means comprises gear means.

10. The invention according to claim 1 in which each pair of jaw elements comprises a pair of jaw plates and spring means biasing each pair of jaw plates together, said spring means resisting the force of said creasing element moving between said jaw plates to force said sheet material into a creased position between said first and second jaw plates in creasing position.

* * * * *